US008356957B2

(12) United States Patent
Weiser

(10) Patent No.: US 8,356,957 B2
(45) Date of Patent: Jan. 22, 2013

(54) SYSTEM AND METHOD OF APPLYING A ROAD SURFACE

(75) Inventor: Ralf Weiser, Ladenburg (DE)

(73) Assignee: Joseph Vögele AG, Ludwigshafen/Rhein (DE)

( * ) Notice: Subject to any disclaimer, the term of this patent is extended or adjusted under 35 U.S.C. 154(b) by 43 days.

(21) Appl. No.: 13/050,271

(22) Filed: Mar. 17, 2011

(65) Prior Publication Data

US 2011/0229264 A1 Sep. 22, 2011

(30) Foreign Application Priority Data

Mar. 18, 2010 (EP) ..... 10002894

(51) Int. Cl.
*E01C 19/00* (2006.01)

(52) U.S. Cl. ..... 404/84.05; 404/72; 404/75

(58) Field of Classification Search ..... 404/84.05–84.8, 404/118, 72, 75
See application file for complete search history.

(56) References Cited

U.S. PATENT DOCUMENTS

| | | | | |
|---|---|---|---|---|
| 4,563,086 | A | 1/1986 | Knapp et al. | |
| 4,828,428 | A * | 5/1989 | Anderson | 404/102 |
| 5,213,442 | A * | 5/1993 | Sovik | 404/102 |
| 5,356,238 | A * | 10/1994 | Musil et al. | 404/84.1 |
| 5,401,115 | A * | 3/1995 | Musil et al. | 404/72 |
| 6,238,135 | B1 * | 5/2001 | Rower | 404/84.5 |
| 6,749,364 | B1 * | 6/2004 | Baker et al. | 404/84.5 |
| 2002/0168226 | A1 * | 11/2002 | Feucht et al. | 404/84.1 |
| 2004/0260504 | A1 | 12/2004 | Bienvenu et al. | |
| 2007/0098496 | A1 * | 5/2007 | Hall et al. | 404/94 |
| 2008/0038059 | A1 * | 2/2008 | Frelich | 404/75 |
| 2008/0260462 | A1 * | 10/2008 | Ackermann | 404/124 |
| 2009/0226255 | A1 * | 9/2009 | Lossow | 404/84.5 |
| 2010/0172696 | A1 * | 7/2010 | Commuri | 404/117 |
| 2011/0293369 | A9 * | 12/2011 | Commuri | 404/117 |

FOREIGN PATENT DOCUMENTS

| | | | |
|---|---|---|---|
| DE | 4040029 | C1 | 4/1992 |
| DE | 10030305 | A1 | 11/2001 |
| DE | 19537691 | C5 | 11/2004 |
| EP | 179636 | A1 | 4/1986 |
| EP | 1544354 | A3 | 11/2007 |
| JP | 7062607 | A | 3/1995 |
| JP | 7121234 | A | 5/1995 |
| JP | 2001249705 | A | 9/2001 |
| JP | 2008524473 | A | 7/2008 |
| WO | WO0070150 | A1 | 11/2000 |

OTHER PUBLICATIONS

Translation of First Office Action, mailed Jul. 17, 2012, which issued in corresponding JP Application No. 055423.

* cited by examiner

*Primary Examiner* — Raymond W Addie
(74) *Attorney, Agent, or Firm* — Fish & Richardson P.C.

(57) ABSTRACT

A system for applying a road surface includes a plurality of operational components each with one or a plurality of adjustment parameters and an open loop control unit from which the adjustment parameters are communicated to the operational components. The system has a closed-loop control unit for determining the optimum adjustment parameters for obtaining at least one specified target value taking into account measurement quantities, for producing a command data set representing a plurality of optimum adjustment parameters and for communicating this command data set to the open loop control unit. The invention also relates to a method for controlling a system for the application of a road surface, in particular a road finisher.

15 Claims, 2 Drawing Sheets

SYSTEM AND METHOD OF APPLYING A ROAD SURFACE

FIELD OF THE INVENTION

The present invention relates to a system for applying a road surface that includes a closed loop control unit and an open loop control unit and a method for using the system to control application of the road surface.

BACKGROUND OF THE INVENTION

The construction and application of asphalt to roads, paths and open spaces is an extremely complicated process. During this process the working result, i.e. the quality of the road surface produced, is not only determined by the adjustment of the machines, but also for example by the properties of the laying mixture (for example asphalt) and by the ambient conditions. Taken together all these parameters determine which quality, for example the smoothness, the road surface actually has.

Previously the machine operator defined the adjustment parameters of the machines. In doing this he oriented his task to the prevailing or the changing boundary or laying conditions—and to his experience. The more skill and experience of the machine operator in handling the relevant machine, the higher the quality of the road surface produced. On the other hand this quality may, however, also be very low if the machine operator has little experience or if he is confronted by previously unknown boundary conditions.

Some suggestions have already been made of how the adjustment of the machines can be arranged to be less dependent on the operator's experience. For example, EP 1 544 354 A2 suggests storing previous empirical values for advantageous operating parameter settings and using them again later as the basic setting for the machine. Starting from this basic setting, the operator only has to carry out fine adjustment of the machine.

German patent DE 40 40 029 C1 suggests setting the frequency of the drive of a compaction unit for a road construction machine in dependence of a predetermined laying rate and predetermined parameters of the layer to be laid. Here a set-point curve fur the temporal progression of the laying rate is specified.

International publication WO 00/70150 A1 and German patent DE 10 2008 058 481 A1 suggest measuring the temperature of a road surface just produced using a suitable sensor and controlling a road finisher or a following compaction machine according to the measured temperature.

A multi-channel control system for a road construction machine is furthermore known from German patent DE 195 37 691 C5. The control, however, only relates to the measurement of the temperature of a smoothing bar and maintaining it constant also in case of failure of a heater element. Feedback with other adjustment or laying parameters does not take place.

Finally, US patent publication 2004/0260504 A1 describes a system for the determination of the properties of a laying mixture. These properties are however only used for quality control and not for the control of the road construction machine.

OBJECT OF THE INVENTION

The object of the invention is to improve a known system and method of applying a road surface such that a higher quality surface is produced in a more reliable manner.

SUMMARY OF THE INVENTION

This object of the present invention is solved by the road laying system of the present invention and with a method of controlling the system for applying a road surface. Advantageous further developments of the invention are given in the dependent claims.

The system according to the invention for the application of a road surface has a control unit, preferably a closed-loop control unit, which is adapted for determining the optimum adjustment parameters for obtaining at least one specified target value taking into account measurement quantities, for producing a command data set representing a plurality of optimum adjustment parameters and for communicating this command data set to an open loop control unit. This configuration produces a range of advantages:

- For the user the main advantage of the system is that he no longer needs to set the individual adjustment parameters of the operational components of a machine based on his experience, for example the slope and temperature of a screed or the frequency of a tamper strip. Instead the user enters target values for the road surface to be applied into the system using a terminal, a data interface or a data medium. With these target values (synonym: process variables) a description of the working result to be obtained, i.e. the road surface to be produced, is involved. Therefore, these target values may comprise for example construction site data, such as the length, width, gradient or course of the road surface to be produced or also information about the sequence of the layers of the road surface, including the thickness of the individual layers. The user can thus now specify the working result and then have confidence that the system will determine the optimum adjustment parameters and readjust them as necessary.
- Since normally significantly fewer target values than adjustment parameters are present, the entry of the target values can take place more quickly than the setting of the individual adjustment parameters when the latter has to be carried out by the user. In addition the effort for adapting the adjustment parameters to the varying ambient conditions is not required. Both of these result in a reduction of the effort in operating the system, thus saving costs.
- The system according to the invention provides for separation of the closed loop control unit from the open loop control unit. The open loop control unit has the task of implementing the specified commands or manipulated variables such that the corresponding adjustment parameters are accepted by the system operational components. In contrast, the closed loop control unit is used to find the optimum manipulated variables or adjustment parameters. This partition has the advantage that an adaptation of the adjustment parameters by the open loop control unit must only then occur when the adjustment parameters have been optimised and have been tested if necessary. Consequently, the adjustment of the system operational components is changed less often which leads to a more uniform working result.
- According to the invention a plurality of adjustment parameters are consolidated by the closed loop control unit and together communicated to the open loop control unit in a vector or command data set. This consolidation of the command data set to form a block or vector is used to reduce the energy required to transfer the command data.

Preferably, the closed loop control unit comprises a controller block and a simulation block connected to it. The controller block can produce a suggestion for a new set of adjustment parameters which is then passed to the simulation block. The simulation block simulates which working result is obtained with the adjustment parameters suggested by the controller block. This simulated working result can then be compared to the specified, targeted working result. If required, the suggested adjustment parameters are once again adapted.

Preferably, the closed loop control unit contains, particularly in its simulation block, a neural network for the simulation of the values of the at least one target value resulting from a group of adjustment parameters. A neural network of this nature is particularly well suited to the complex operating environment during the application of a road surface, in which almost all adjustment parameters are present in a complex, mutually dependent relationship, so that changing one adjustment parameter can cause a change in many of the other quantities. Instead of a neural network however other comparable algorithms can be used.

The system itself can preferably have a mixer, a site station and/or a plurality of machines relatively movable to one another, for example, trucks, cutters, loaders, finishers and/or rollers which themselves may each have one or a plurality of operational components.

It is particularly advantageous if sensors are provided for acquiring the measurement quantities and if these sensors pass the measurement quantities they acquire to the closed loop control unit.

The invention also relates to a method for controlling a device or a system for the application of a road surface, in particular a road finisher. With this method a group of optimum adjustment parameters are determined in a closed loop control unit from measurement quantities and from at least one specified target value to obtain this at least one target value, and the group of adjustment parameters is communicated from the closed loop control unit to the open loop control unit in a common command data set.

It is expedient if the determination of the optimum adjustment parameters for obtaining the at least one target value is carried out repeatedly in the operation of the device. In this way a continuous or at least a repeatedly executed check of the adjustment parameters and, if necessary, an adaptation of the settings to changing ambient conditions can take place in order to achieve an optimum working result. The working result is optimum when it approaches as closely as possible the specifications prescribed by the target values.

The renewed determination of the optimum adjustment parameters for obtaining the at least one target value could always be executed in the operation of the device when a measurement quantity deviates from a target value by a predetermined amount, and/or each time a predetermined time interval expires. The latter has the advantage that the renewed execution of the optimisation becomes independent of the determination of individual measurement quantities and therefore, for example, of the failure of individual sensors.

Preferably, a simulation can be carried out in the closed loop control unit for the determination of the optimum adjustment parameters using a group of adjustment parameters to determine which values of the at least one target value are produced with these adjustment parameters. This simulation of the target values or of the process result facilitates a conclusion to be drawn about how well the specified target values have been obtained. From this it can be derived which adjustment parameters may still need to be improved.

For the "optimum" in the method according to the invention such adjustment parameters can be defined when the values of the at least one target value produced in the simulation with these adjustment parameters lie within a specified tolerance of the at least one target value. For example, it can be specified that the width of the road surface to be produced can deviate by +/−two centimeters from the specified target value. With the next simulation or with a suggestion for a new group of adjustment parameters the adjustment parameters already determined as "optimum" can be retained or however a suggestion may follow for a new group of adjustment parameters with which the adjustment parameters already defined as "optimum" are checked and, if necessary, modified.

Similarly preferably in the closed loop control unit a group of modified adjustment parameters can be iteratively defined and with these modified adjustment parameters a simulation of the values of the at least one target value produced with the modified adjustment parameters can be carried out. This iterative simulation has the advantage that the adjustment parameters can be continuously adapted and optimised in the operation of the device. It is conceivable that the iterative process is executed until the values of the at least one target value produced during the simulation lie within a specified tolerance of the at least one target value. When all target values can be obtained within a specified tolerance during the simulation, the complete group of adjustment parameters can be considered as "optimum" and retained.

It is expedient if the operator of the machine is informed whether the specified target values can be achieved. In this way the operator can be informed promptly when a desired working result cannot be obtained or at least not within a specified tolerance. In this way the operator can check the specification of the target values and if necessary prepare suitable measures for obtaining the target values.

When a group of adjustment parameters is recognised as being "optimum", this group can be communicated in a common vector or command data set from the closed loop control unit to the open loop control unit, whereupon the open loop control unit carries out the adaptation of the individual operational components to the specified adjustment parameters. Here it is conceivable that the complete command data set of all possible adjustment parameters is always communicated to the open loop control unit. The effort for the transfer of the command data set can however be reduced if only the changing adjustment parameters are communicated to the open loop control unit. With the command data set it is then signalled to the open loop control unit which adjustment parameters are to be modified.

DESCRIPTION OF THE DRAWINGS

In the following an advantageous embodiment of the invention is presented in more detail based on a drawing. The following are shown.

DETAILED DESCRIPTION

Figure 1:
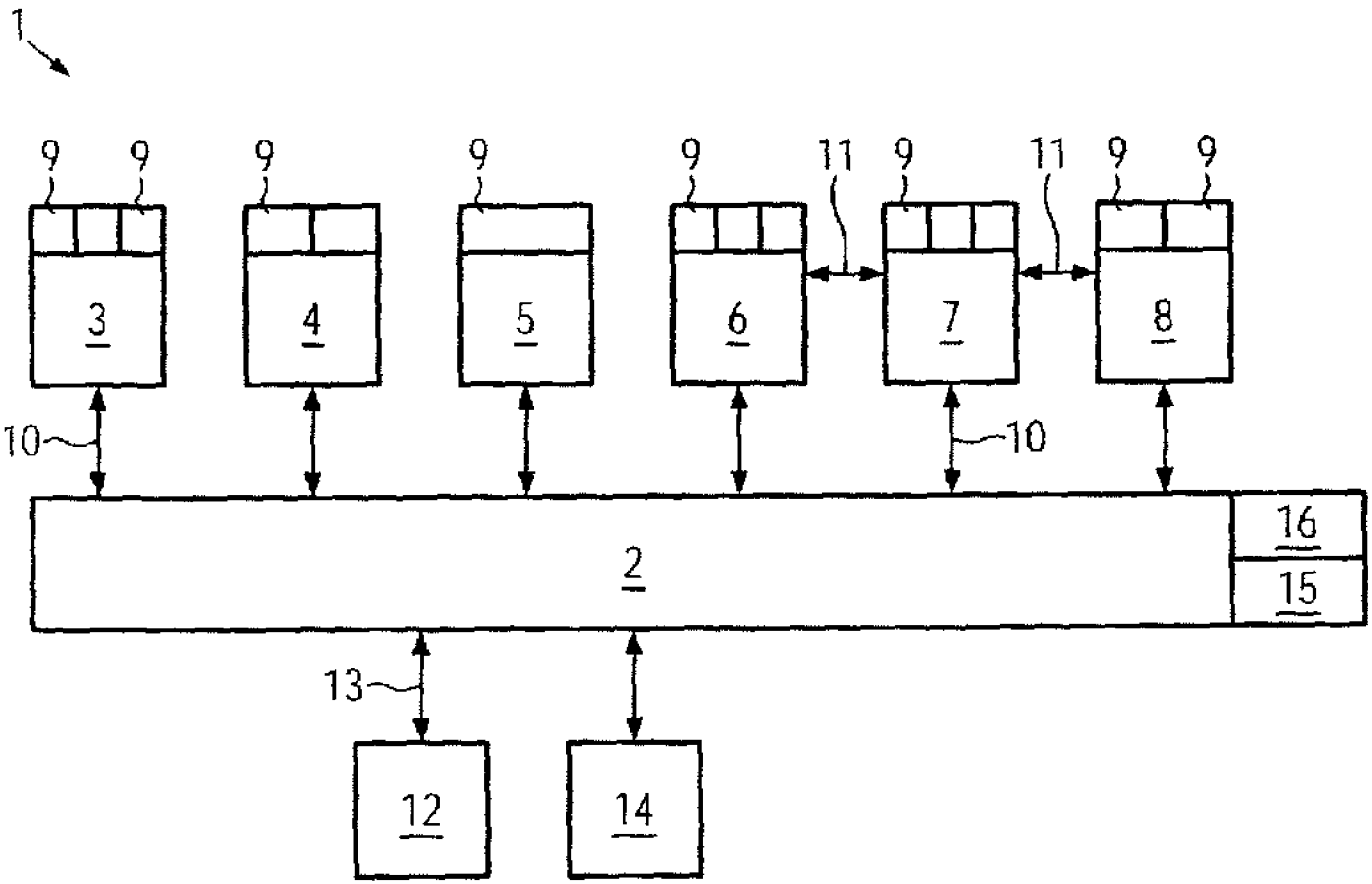
FIG. 1 is a schematic structural view of the system according to the invention and FIG. 2 is a schematic representation of the functional components in the system according to the invention.

In the figures identical components are designated with the same reference numerals throughout.

FIG. 1 illustrates in a schematic representation a system 1 according to the invention for applying a road surface. This system 1 comprises a site station 2 or a central site office 2 which is set up on the road works site or on a machine or is externally set up and which co-ordinates the operational procedures on the site. Part of the system 1 is also formed by an asphalt or mixing facility 3 and a plurality of machines, which are movable between the mixing facility 3 and the road works site and/or on the road works site. This machine may be a truck 4 transporting a laying mixture, a cutter 5, a loader 6, a road finisher 7 and a compaction roller 8. Some of these machines or also the mixing facility 3 may also be omitted in the system 1 according to the invention, or a plurality of mixing facilities 3 and/or a plurality of machines 4 to 8 of a certain type may be present.

The mixing facility 3 and each of the machines 4 to 8 have one or a plurality of operational components 9, the operating principle or adjustment of which is determined by one or a plurality of adjustment parameters. With the mixing facility 3 the operational components 9 may involve for example screw conveyors, mixers or heating devices for producing the laying mixture. With the movable operational components 4 to 8 an operational component may involve the drive of the relevant machine, including the control. With the truck 4 a further operational component may be a lifting mechanism for tipping the loading area. With the road finisher 7 an operational component 9 is included in the drive of the conveyor with which laying mixture is transported from the material bunker to the screed. Other operational components 9 are for example the screed, press strips and/or so-called "tampers" on which the setting angle, vibration or oscillation can be adjusted, as well as heating devices.

Between the site station 2 and the mixing facility 3 and between the site station 2 and each of the machines 4 to 8 there is a channel 10 for wireless data transmission. The site station 2, mixing facility 3 and the machines 4 to 8 each have suitable interfaces available for the data transmission channel 10. Further wireless data transmission channels 11 can be set up between individual machines 6, 7, 8. The data transmission channels 10, 11 can for example be set up as radio links, as infrared links, as Internet links or via satellites.

The system 1 illustrated in FIG. 1 also has input and output devices 12 available, for example a laptop or a PDA, which are mobile and alternatively can be linked to the site station 2 via a data transmission channel 13. In addition the site station 2 can be linked via a similar data transmission channel 13 to an external device, for example in an architectural or planning office 14.

An input device 15 is provided at the site station 2, for example, a keyboard, CD or DVD drive or a memory card interface. With this input device 15 at the site station 2 target values for the road surface to be produced can be entered, for example the course and width of the road surface, degree of compaction, laying thickness, flatness and/or the surface texture of the desired road surface. Furthermore, a display device 16 is provided at the site station 2, for example a monitor, on which the entered target values and the measurement quantities obtained from within the system 1 are illustrated and warning information presented to the operator of the system 1 during critical situations.

Figure 2:
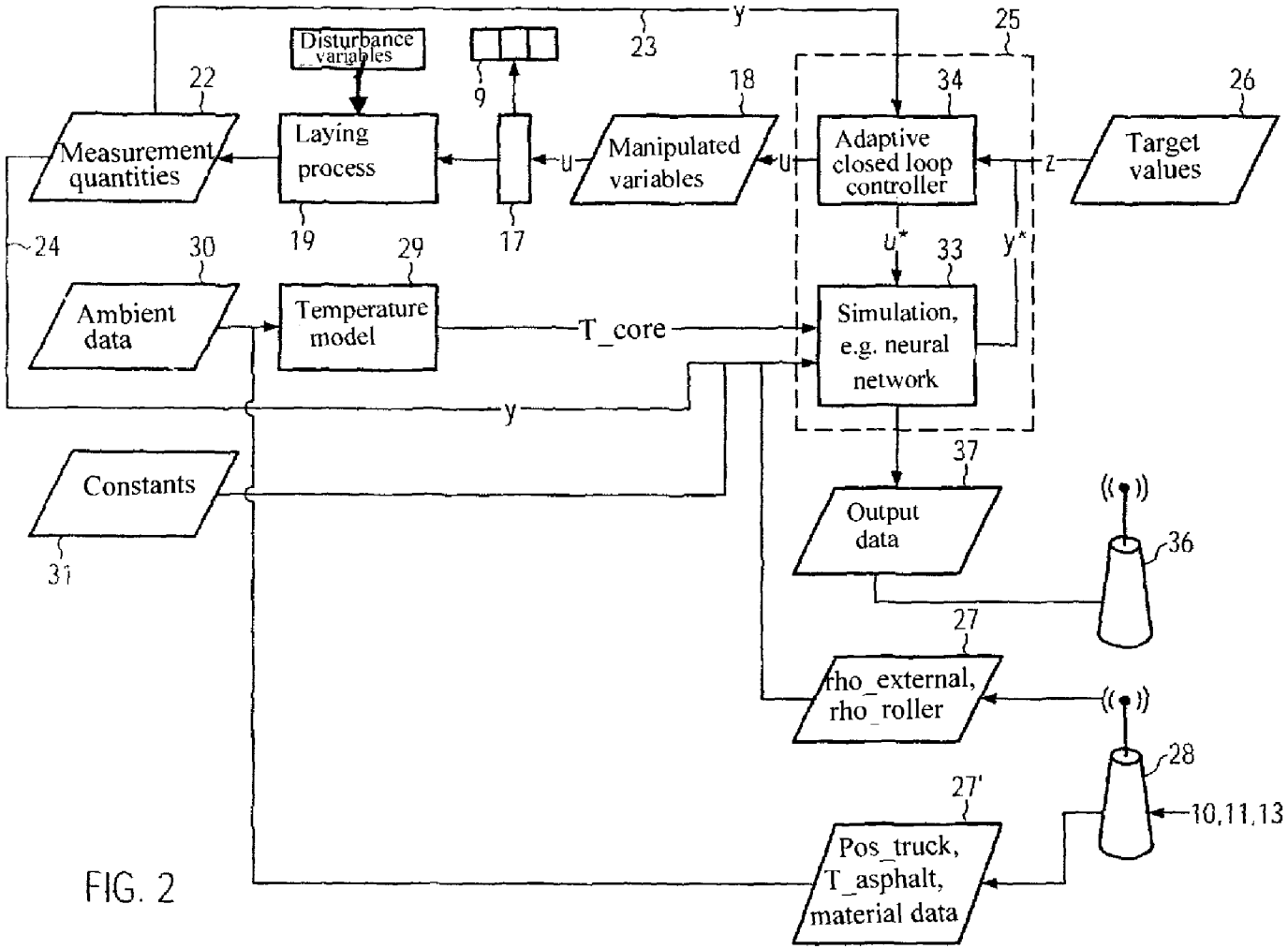

Whereas FIG. 1 illustrates the structural components of the system 1 according to the invention, FIG. 2 illustrates the functional components of the system 1 as well as the data transmitted within the system 1. (The latter symbolised by parallelograms.)

As illustrated in FIG. 2, the system 1 comprises an open loop control unit 17. It has the task of receiving a specification u for manipulated variables or adjustment parameters 18, converting them into machine commands and distributing them to the individual operational components 9 so that the operational components 9 are adjusted according to the specified adjustment parameters 18. From the adjustment and operation of the various operational components 9 the overall actually running operational or laying process 19 is generated. The road surface to be produced is provided by this laying process 19. The laying process 19 is not just determined by the adjustment of the operational components 9, but also by the influence of disturbance variables, for example the ambient temperature, wind or shade.

The system 1 has a plurality of sensors (not illustrated) with which the measurement quantities 22 are obtained. These measurement quantities may involve, for example, the setting angle of the screed, the laying thickness or the asphalt temperature of part of the road surface which has already been laid, the soil stiffness or quantities derived from it (acceleration) or the determined density of the laid asphalt.

The group y of measurement quantities 22 is passed via an output feedback 23, 24 to the closed loop control unit 25, the function of which is the optimisation of the laying process 19 through the optimisation of the adjustment parameters. The closed loop control unit 25 also receives, via a suitable interface, the target values 26, which define the working result to be achieved, i.e. the properties of the road surface to be produced. These target values 26 may be, for example, the laying thickness of the road surface, the setting angle of the screed or the desired thickness of the laid asphalt. The target values 26 can, for example, be entered into the system 1 from the mobile terminal device 12, from the planning office 14 or via the input device 15.

In addition to the target values z, 26 and the measurement quantities y, 22 the closed loop control unit 25 receives external data 27, which have been acquired externally and communicated to a receiver 28 via a data transmission channel 10, 11, 13. These external data 27 may be, for example, external values, for example, of the asphalt density determined by a Troxler probe or an asphalt density determined by the roller 8. These density values or other data 27 are supplied by the receiver 28 directly to the closed loop control unit 25.

A second group of external data 27', which have also been received at the receiver 28, are initially passed to a modelling unit 29. This group of external data 27' may be, for example, the position of a delivery truck 4, the asphalt temperature, information about the mix recipe and the amount of mix, i.e. position and material data. In the modelling unit 29 these position and material data 27' are coupled to the ambient data 30, which, for example, reflect the ambient temperature, soil temperature, wind direction, wind speed, and the strength and direction of the solar radiation. From the ambient data 30 and the position and material data 27' the modelling unit 29 calculates a value T_core for the core temperature of the laid mix. This temperature can only be determined by calculation, because the core of the road surface is not accessible to a direct temperature measurement. Here, the modelling unit 29 applies a dissertation, i.e. "Use of core temperature prediction for the compaction of asphalt mixture in road construction" (German original title: "Nutzung der Kerntemperaturvorhersage zur Verdichtung von Asphaltmischgut im Straβenbau"), J. Wendebaum, University of Karlsruhe, July 2004.

Finally, some constants 31 are entered into the closed loop control unit 25 as further data. These constants 31 are values which remain constant during the laying process, for example the width of the screed, mass of the screed on the road finisher 7, or the geometrical boundary conditions of a machine 4 to 8.

The closed loop control unit 25 comprises a simulation block 33 and a controller block 34. The controller block 34 can be designed as an adaptive closed loop controller. Based on the measurement quantities y, 22, target values z, 26 and the simulated process variables y* simulated by the simulation block 33, the adaptive closed loop controller is able to produce a suggestion for a set of new adjustment quantities u*. This suggestion for new adjustment parameters u* is communicated to the simulation block 33.

The simulation block 33 is configured to simulate process variables y* based on the adjustment parameters u*, the measurement quantities y, 22 suggested by the controller block 34, the constants 31, the external data 27 and the values modelled by the modelling unit 29. This simulation predicts the working result which would be achieved under the prevailing boundary conditions with the adjustment parameters u* suggested by the controller block 34. The simulation block 33 can be implemented in the form of a neural network. Alternatively, linear or non-linear models or algorithms from analyses of variance could be implemented in the simulation block 33.

The system 1 illustrated in FIG. 2 also has a transmission interface 36. Output data 37 can be made available to this transmission interface 36 by the closed loop control unit 25 to be communicated from the transmission interface 36 to other components of the system 1. The output data 37 may be for example the calculated or simulated asphalt density or asphalt core temperature, the position of individual machines 4 to 8 of the system, predictions about the requirement of auxiliary and operating materials for the machines 4 to 8, an amount or composition of laying mixture required by the mixing facility 3, etc.

Each machine 4 to 8 and also the mixing facility 3 can be assigned a machine identification in the system 1. This machine identification is used during wireless communication between the individual components of the system 1 for the identification of the transmitting or receiving machine.

In FIG. 2 all data or quantities, which are communicated in the system 1, are represented by parallelograms. It should be noted that these data or quantities (apart from the constants 31) may depend on the location and/or time.

In the following the procedure of the inventive method or the operation of the inventive system 1 for applying a road surface is explained.

At the start of the operational process target values 26 are entered into the system, which define the required working result, for example the thickness and the course of a road surface to be applied as well as its required compaction. In addition tolerance ranges are specified for the individual target values 26. Within this tolerance range the working result is assessed as "satisfactory" or as "optimum".

The target values z, 26 and the respective tolerance ranges are passed to the controller block 34. Taking into account the measurement quantities y, 22 already available, the adaptive closed loop controller 34 suggests a set u* of adjustment parameters for the operational components 9 of the system 1. This suggestion for the adjustment parameters u* is made available to the simulation block 33. The simulation block 33 simulates which process result y* is produced with the suggested adjustment parameters u*. This simulated process result y* is in turn passed to the adaptive closed loop controller 34 where it is compared to the target values z, 26. If the simulated process result y* lies within the tolerance ranges for the individual target values 26, the suggested group u* of adjustment parameters is defined as "optimum". From these "optimum" adjustment parameters the controller block 34 composes a command data set u which is communicated as a vector by the adaptive closed loop controller 34 to the open loop control unit 17. The manipulated variables or adjustment parameters 18 within the vector or command data set u may, for example, comprise the following settings: The tamper rotational speed, tamper stroke, frequency of the tamper vibration, eccentric mass of the vibration, eccentricity of the vibration, frequency of the press strip(s), press strip pressure, rotational speed of the conveyor, rotational speed of the screw conveyor and/or the laying rate (if the controlled machine is a road finisher 7).

If in contrast it is found in the adaptive closed loop controller 34 that the simulated process variables y* lie outside of the tolerance ranges for the target values 26 or for at least one target value 26, the controller block 34 adapts the adjustment parameters with regard to closer attainment of the specified target values 26. The suggestion for new adjustment parameters u* resulting from this is in turn passed to the simulation block 33 in order to simulate here the process variables y* arising from it. This process is repeated until the complete group of adjustment parameters is considered as "optimum" or until a specified cancellation criterion is reached. With a cancellation criterion of this nature, for example after ten alternative iterations of the closed-loop control circuit inside the closed-loop control unit 25, a message regarding the cancellation of the simulation process can be output via the transmission interface 36 to the operator.

The vector u of "optimum" manipulated variables or adjustment parameters 18 is communicated to the open loop control unit 17. The open loop control unit 17 converts the specified manipulated variables into machine commands and communicates them to the operational components 9 to adjust them according to the specified parameters.

During the laying process 19 measurement quantities 22 are acquired and passed to the controller block 34 or the simulation block 33 via the output feedback 23, 24. Simultaneously, the simulation block 33 receives the prediction from the modelling unit 29, which is produced from the ambient data 30 and the position and material data 27'.

In the closed loop control unit 25 an iterative simulation of the process variables y* is carried out continuously or in each case after specified time intervals to specify new adjustment quantities. Before these are passed to the open loop control unit 17, the suggested adjustment quantities u* are passed to the simulation block 33 to predict the process result y* produced by them. This offers the advantage of only carrying out the adaptation of the adjustment quantities on the machines when the simulation has demonstrated that a better working result can actually be achieved with the modified adjustment quantities.

During the operation of the system certain output data 37 can be made available to the other components of the system 1 via the transmission interface 36. Simultaneously, external data can be fed via the receiver 28.

In one embodiment of the system 1 according to the invention all the components illustrated in FIG. 2 are located on one machine, for example on a road finisher 7. Using the interfaces 28, 36, the road finisher 7 communicates with the other components 2, 3 to 6, 8, 12, 14 of the system 1.

In another embodiment, of the components illustrated in FIG. 2 only the open loop control unit 17 and the operational components 9 are located on the relevant machine 3 to 8. The other parts of the system are, for example, arranged in the site station 2. Also the closed loop control unit 25 in this embodiment would be located at the site station 2. In this case the command data set u, i.e. the vector of manipulated variables or adjustment parameters 18, would be communicated via the channel 10 from the closed loop control unit 25 (on the site station 2) to the open loop control unit 17 (on the relevant machine 3 to 8).

Starting from the illustrated embodiment, the system 1 according to the invention and the method according to the invention can be modified in many ways for applying a road surface. Of course, here the chosen target values and the adjustment parameters 18 to be set may depend on the configuration of the relevant operational components 9.

The system according to the invention offers the advantage that an operator only has to specify the target values 26 for the laying process and not the individual adjustment parameters 18. These adjustment parameters 18 are automatically determined by the system 1 and continuously optimised. FIG. 2 shows that the control of the system 1 according to the invention operates with a closed loop control circuit. Using simulation, the effect of newly suggested manipulated variables u* is predicted to optimise the actual adjustment parameters.

It is conceivable that the simulation can be carried out during the input of the target values 26. In this case it would be possible for target values entered later to be allowed only certain ranges of values which can still be obtained with the earlier entered target values. In addition, the operator can in this case be provided with feedback if the entered target values are not realistic, because they cannot be achieved with the existing machines. The operator then has the opportunity of again checking the entered target values 26.

What is claimed is:

1. System for the application of a road surface having (i) a plurality of operational components, each component comprising at least one adjustment parameter, (ii) an open loop control unit for communicating the adjustment parameters to the operation components (iii) a closed loop control unit, which receives measurement quantities, for determining optimum adjustment parameters, achieving at least one specified target value, producing a common data set (u) representing a plurality of optimum adjustment parameters and for communicating this common data set (u) representing a plurality of adjustment parameters to the open loop control unit, and the closed loop control unit having a controller block and a simulation block comprising a neural network or a linear or non-linear model or algorithms from analysis of variants for simulating the values produced from a group of adjustment parameters of the at least one target value, the simulation block being separated from the controller block and linked for bi-directional data communication to the closed loop control unit, and the simulation block, comprising a neural network or a linear or non-linear model or algorithms from analysis of variants tier simulating the values produced from a group of adjustment parameters of the at least one target value.

2. System according to claim 1, comprising an asphalt plant, a site station and/or a plurality of machines relatively movable to one another.

3. System according to claim 2, further comprising interfaces for wireless data transmission between the mixing facility, the site station and/or the machines.

4. System according to claim 1, further comprising sensors for the acquisition of the measurement quantities.

5. Method for controlling a system for applying a road surface comprising a plurality of operation components, each component comprising at least one adjustment parameter, and an open loop control unit for communicating the adjustment parameters to the operation components, the method comprising determining a group of optimum adjustment parameters for achieving at least one target value in a closed loop control unit from measurement quantities and from the at least one specified target value, and the group of adjustment parameters in a common command data set from the closed loop control unit to the open loop control unit, repeatedly determining the optimum adjustment parameters for achieving the at least one target value, conducting a simulation in a simulation block separated from a controller block of the closed loop control unit to determine which values of the at least one target value are produced with the adjustment parameters determining the optimum adjustment parameter from among a group of adjustment parameters, and defining the adjustment parameters as optimum adjustment parameters when the values of the at least one target value produced during the simulation lies within a specified tolerance of the at least one target value.

6. Method according to claim 5, determining the optimum adjustment parameters for achieving the at least one target value is after the expiration of a specified time interval during the operation of the system.

7. Method according to claim 5, which comprises iteratively defining a group (u*) of modified adjustment parameters, and carrying out a simulation of the values (y*) of the at least one target value produced with the modified adjustment parameters with the modified adjustment parameters.

8. Method according to claim 7, which comprises carrying out the iterative process until the values (y*) of the at least one target value produced during the simulation lie within a specified tolerance of the at least one target value.

9. Method according to claim 5, which comprises providing the operator with a display capable of indicating whether the specified target values can be achieved.

10. Method according to claim 5, which comprises communicating only the adjustment parameters to be modified in a common command data set (u) from the closed loop control unit to the open loop control unit.

11. Method according to claim 5, which comprises conducting the simulation in the closed loop control unit.

12. Method according to claim 7, which comprises iteratively defining the group of modified adjustment parameters in the closed loop control.

13. The method according to claim 5, wherein the system comprises a road finisher.

14. The system according to claim 1, comprising a road finisher.

15. Apparatus for application of a road surface comprising:

a plurality of operational components, each operational component controlling at least one adjustment parameter for application of the road surface, an open loop control unit for communicating the adjustment parameters to the operational components, a closed loop control unit which receives a measurement data for determining optimum adjustment parameters for achieving at least one specified target value for at least one operational component, produces a command data set and communicates the command data set representing a plurality of adjustment parameters to the closed loop control unit, the closed loop control unit having a controller block and a simulation block comprising a neural network or linear or non-linear models or algorithms from analysis of variants implemented in the simulation block for simulating the values produced from a group of adjustment parameters of the at least one target value, the simulation block being separated from the controller block and linked to the closed loop control unit for bi-directional data communication.

* * * * *